United States Patent [19]

Luce

[11] 4,228,717

[45] Oct. 21, 1980

[54] ELECTRONIC MUSICAL INSTRUMENT CAPABLE OF GENERATING A CHORUS SOUND

[75] Inventor: David A. Luce, Clarence Center, N.Y.

[73] Assignee: Norlin Industries, Inc., Lincolnwood, Ill.

[21] Appl. No.: 911,716

[22] Filed: Jun. 2, 1978

Related U.S. Application Data

[63] Continuation-in-part of Ser. No. 696,195, Jun. 15, 1976, Pat. No. 4,145,943, and a continuation-in-part of Ser. No. 588,508, Jun. 19, 1975, Pat. No. 4,099,439.

[51] Int. Cl.[3] ..... G10H 1/02; G10H 5/06

[52] U.S. Cl. ..... 84/1.24; 84/DIG. 4; 84/DIG. 11

[58] Field of Search ..... 84/1.01, 1.24, DIG. 4, 84/DIG. 11

[56] References Cited

U.S. PATENT DOCUMENTS

| | | | |
|---|---|---|---|
| 3,347,973 | 10/1967 | Freeman | 84/1.24 |
| 3,450,825 | 6/1969 | Cunningham | 84/1.24 |
| 3,764,721 | 10/1973 | Maynard | 84/1.24 |
| 3,790,693 | 2/1974 | Adachi | 84/1.01 |
| 3,800,060 | 3/1974 | Hallman, Jr. | 84/1.24 |
| 3,816,635 | 6/1974 | Uetrecht | 84/1.01 |
| 3,821,460 | 6/1974 | Maynard | 84/1.01 X |
| 3,828,109 | 8/1974 | Morez | 84/1.01 |
| 3,939,751 | 2/1976 | Harasek | 84/1.01 X |
| 3,956,961 | 5/1976 | Peterson | 84/1.24 |
| 3,978,755 | 9/1976 | Woron | 84/1.24 |
| 4,056,995 | 11/1977 | Uetrecht | 84/1.01 |
| 4,063,484 | 12/1977 | Robinson | 84/1.24 |

*Primary Examiner*—Stanley J. Witkowski
*Attorney, Agent, or Firm*—Jack Kail; Ronald J. Kransdorf

[57] ABSTRACT

The disclosure describes improved apparatus for use in an electronic musical instrument having a keyboard including a group of keys corresponding to the notes of a musical scale. Electronic circuitry is used to generate simultaneously with respect to each of the keys first and second electrical tone signals, the repetition rates of which are detuned with respect to each other so that the sound of a chorus is simulated.

The disclosure also describes circuitry useful in an electronic musical instrument having a keyboard including twelve keys corresponding to the twelve notes of a chromatic musical scale. The circuitry generates simultaneously a first series of twelve tone signals corresponding to a first tempered scale and a second series of twelve tone signals corresponding to a second tempered scale different from the first tempered scale. Each time a key is actuated, a pair of tone signals, one from each of the first and second series, is mixed and converted to an acoustical wave in order to simulate a chorus effect.

4 Claims, 9 Drawing Figures

OSCILLATOR
300
TOS
TOS
DIVIDER
DIVIDER
DIVIDER
DIVIDER
DIVIDER
MOD K
C8
B7
A#7
A7
G#7
G7
F#7
F7
E7
D#7
D7
C#7
C7
B6
A#6
A6
G#6
G6
F#6
F6
E6
D#6
D6
C#6
C6
AMP
MOD OSCILLATOR
MOD OSCILLATOR
WAVE SHAPE CONTROL
WAVE SHAPE CONTROL

TOS
C#8
C8
58
64
62
78
59
TOS
C8
120
128
180
12 ONE STAGE DIVIDERS
80
B7
A#7
A7
G#7
G7
F#7
F7
E7
D#7
D7
C#7
C7
205
95
204
94
203
93
202
92
201
91
200
90
199
89
198
88
197
87
196
86
195
85
194
84
193
T1 C8 T2
T1 B7 T2
T1 A#7 T2
T1 A7 T2
T1 G#7 T2
T1 G7 T2
T1 F#7 T2
T1 F7 T2
T1 E7 T2
T1 D#7 T2
T1 D7 T2
T1 C#7 T2
T1 C7 T2
130
145
144
143
142
141
140
139
138
137
136
135
134
98
148
150
12 ONE STAGE DIVIDERS
100
B6
A#6
A6
G#6
G6
F#6
F6
E6
D#6
D6
C#6
C6
115
114
113
112
111
110
107
108
107
106
105
104
192
191
190
189
188
187
186
185
184
183
182
181
T1 B6 T2
T1 A#6 T2
T1 A6 T2
T1 G#6 T2
T1 G6 T2
T1 F#6 T2
T1 F6 T2
T1 E6 T2
T1 D#6 T2
T1 D6 T2
T1 C#6 T2
T1 C6 T2
165
164
163
162
161
160
159
158
157
156
155
154
174
118
168
170
B5
A#5
A5

ELECTRONIC MUSICAL INSTRUMENT CAPABLE OF GENERATING A CHORUS SOUND

CROSS-REFERENCE TO RELATED APPLICATIONS

This is a continuation-in-part of application Ser. No. 588,508, filed June 19, 1975, in the name of David A. Luce, entitled "Electronic Musical Instrument with Dynamically Responsive Keyboard" and now U.S. Pat. No. 4,099,439, and of application Ser. No. 696,195, filed June 15, 1976, in the name of David A. Luce, entitled "Electronic Musical Instrument Capable of Generating a String Chorus Sound" and now U.S. Pat. No. 4,145,943, both of said patents being assigned to Norlin Music, Inc.

BACKGROUND AND SUMMARY OF THE INVENTION

This invention relates to electronic musical instruments, and more particularly relates to such instruments employing a keyboard in order to simulate the sounds of non-keyboard instruments.

String instruments which are bowed, such as violins and cellos, have long been known for their singular qualities of expressiveness and tone color which have made them the premier instruments in western orchestras for hundreds of years. These instruments create many harmonics of each fundamental note played on them, and this characteristic, in large part, is responsible for their rich tone color or timbre. Excitement is added by the fact that the tone color or timbre of these instruments changes as they are played. Even minute changes in the bowing pressure and position of the fingers on the finger board of the instruments, create differences in the intensity and identity of the harmonics. As a result, the harmonics of a single bowed instrument change in a complex way, and the harmonics of multiple bowed instruments played simultaneously involve random and complicated changes which defy mathematical analysis.

Multiple bowed instruments often are played simultaneously in order to form a strong chorus. The blending of the sounds of the multiple instruments in the chorus creates an audible sensation which is qualitatively different from the sound of a solo instrument. The variations in sound created by the eccentricities of the individual players of the chorus combine to form a rich sonority which is pleasing to the ear.

Since the sound of a string chorus requires a performance by many skilled and dedicated musicians, it is an expensive art form which is generally reserved for a concert stage. Because of the expense and difficulty of obtaining a string chorus sound with natural acoustical instruments and musicians, it is highly desirable to design an electronic musical instrument which can simulate this sound. While the foregoing discussion has been concerned with the production of a string chorus, it will be appreciated that similar considerations apply to the production of chorus effects by ensembles of other musical instruments.

Accordingly, it is a primary object of the present invention to provide an electronic musical instrument which simulates the sound of a string chorus or the chorus effect of an ensemble of other musical instruments.

Another object of the present invention is to provide an electronic musical instrument playable by a keyboard which simulates the sound of a string chorus or the chorus effect produced by an ensemble of other musical instruments.

In accordance with these objects, the present invention can be used in connection with electronic musical instruments having a keyboard including twelve keys corresponding to the twelve notes of a chromatic musical scale. Circuitry simultaneously generates a first series of twelve tone signals corresponding to a first tempered scale in response to a first clock signal and a second series of twelve tone signals corresponding to a different second tempered scale in response to a second clock signal, the clock signals being related in frequency by an amount equivalent to a semitone. A pair of tone signals, one from each of the first and second series, corresponds to each of the keys. When a key is actuated, the tone signals from the first and second series tuned according to the different tempered scales are mixed and converted to an acoustical wave which simulates a chorus effect.

DESCRIPTION OF THE DRAWINGS

These and other objects, advantages and features of the present invention will hereafter appear in connection with the accompanying drawings wherein like numbers refer to like parts throughout, and wherein.

DESCRIPTION OF PREFERRED EMBODIMENT

Figure 1:
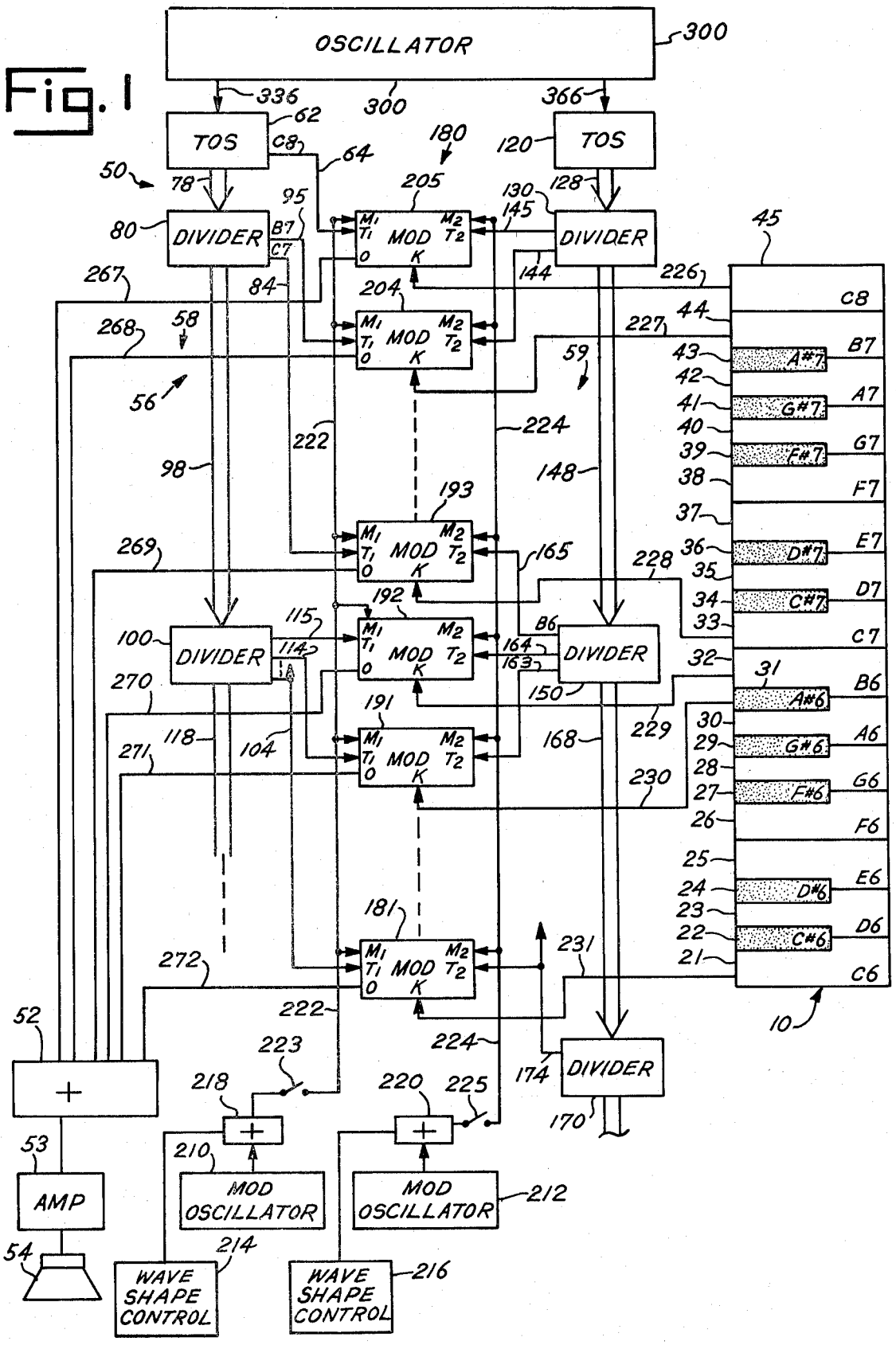
FIG. 1 is a schematic block diagram of a preferred form of musical instrument made in accordance with the present invention.

Referring to FIG. 1, a preferred form of a musical instrument made in accordance with the present invention basically comprises a keyboard 10, a generator 50 which generates tone signals, a mixer 52 which electrically mixes or sums the tone signals, and an amplifier 53 and loud speaker 54 which convert the mixed tone signals into a corresponding acoustical wave. Mixer 52, amplifier 53 and loud speaker 54 are well-known components in the art, and need not be described in detail.

Keyboard 10 can take the form of any conventional musical keyboard, such as found in a piano or organ. Although two octaves of keys are illustrated in FIG. 1, additional octaves could be added depending on the scope of the instrument desired. As shown in FIG. 1, keyboard 10 includes keys 21–45. Keys 21–32 are used for playing the second octave of the instrument, and keys 33–45 are used to play the top octave of the instrument (i.e., the octave highest in pitch).

As shown on FIG. 1, the keys are labeled with the pitch of the note played by each key. For example, if the lowest C note on a piano keyboard is designated C1, key 21 is used to produce a pitch corresponding to the sixth C on the piano keyboard (C6). C6, of course, is two octaves below the highest C on the piano keyboard (C8). Likewise, the black notes on the piano keyboard are designated by a sharp (#). For example, key 43 is used to play the note A#7, the highest pitched black note on a conventional piano keyboard. The same notation is used in connection with FIGS. 1A and 2.

Tone signal generator 50 basically comprises a divider system 56, a modifier and control system 180, and an oscillator system 300.

Referring to FIG. 1, a divider system 56 can be divided into a first channel of components 58 and a second channel of components 59. Referring to channel 58, a top octave synthesizer 62 receives clock pulses at a rate of about 1.5–2.0 MHz (Megahertz) from oscillator 300. In a well-known manner, the synthesizer generates chromatic frequencies corresponding to the semitones or notes within an octave which is one octave higher in pitch than the highest octave on the keyboard. The manner in which these tones are generated is illustrated in FIG. 1A.

Figure 1A:
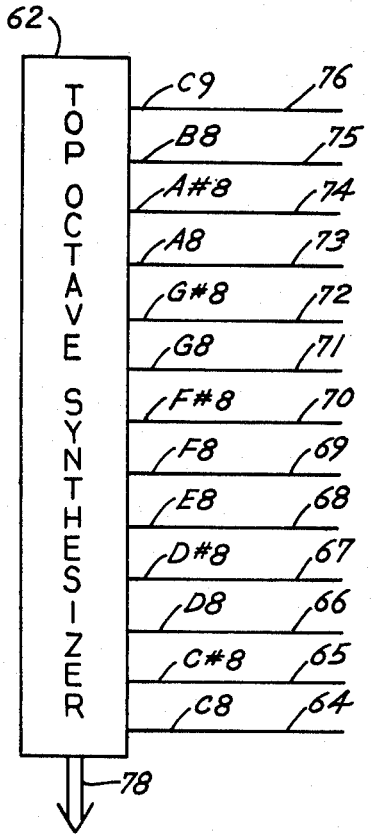
FIG. 1A is a schematic block diagram of a preferred form of top octave synthesizer as shown in FIG. 1.
Figure 7:
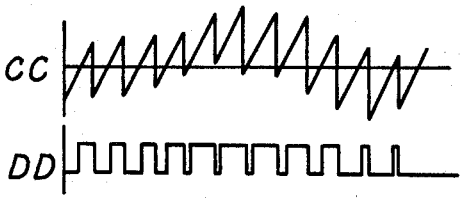
FIG. 7 is a waveform diagram showing the voltage waveforms generated at points CC and DD of FIG. 6.

As shown in FIG. 1A, top octave synthesizer 62 may comprise a conventional device such as generator MM5832, MM5833, manufactured by National Semiconductor Corporation. Synthesizer 62 takes the clock pulses generated by oscillator 300, divides them an appropriate number of times, and produces corresponding tone pulse waveforms on output taps 64–76 which correspond to pitches or notes C8, C#8, D8, D#8, E8, F8, F#8, G8, G#8, A8, A#8, B8 and C9, respectively.

The repetition rates of the tone pulse waveforms on output taps 64–76 correspond to a particular tempered scale. Musicians, and those skilled in the design of musical instruments, recognize that tempering is a system of tuning in which the intervals within an octave deviate from the pure intervals of the Pythagorean system. The deviations are necessary because the Pythagorean system, although perfect within a small range of tones in one key, becomes inadequate if the musician attempts to play in other keys. Most modern keyboard instruments are tuned with a tempering system known as the equally tempered scale. According to the system of equal temperment, as octave is divided into twelve equal semitones. Since the frequency ratio of the octave is two, the frequency ratio S of a semitone is given by the equation $S=\sqrt[12]{2}=1.05946$. Sometimes a logarithmic measurement is also used in connection with equal temperment in which the whole octave equals twelve hundred cents and the interval of pitch between each semitone equals one hundred cents. Thus, a change in frequency of 0.05946% is a change in frequency of 1 cent.

Commercially available top octave synthesizers closely approximate the equally tempered scale, but deviate from it to a slight extent. For example, in the case of the National Semiconductor synthesizer described above, assuming as input repetition rate of 2.00024 MHz, the resulting error in cents from the true equally tempered scale is illustrated in Table A:

TABLE A

| Note | Output Frequency | Equally Tempered Scale Frequency | Cent Error |
|---|---|---|---|
| C9 | 8369.21 | 8372.02 | −0.565 |

TABLE A-continued

| Note | Output Frequency | Equally Tempered Scale Frequency | Cent Error |
|---|---|---|---|
| B8 | 7906.09 | 7902.13 | 0.842 |
| A#8 | 7463.58 | 7458.62 | 1.119 |
| A8 | 7043.10 | 7040.00 | 0.740 |
| G#8 | 6645.32 | 6644.88 | 0.112 |
| G8 | 6270.34 | 6271.93 | −0.424 |
| F#8 | 5917.87 | 5919.91 | −0.580 |
| F8 | 5587.26 | 5587.65 | −0.117 |
| E8 | 5277.68 | 5274.04 | 1.160 |
| D#8 | 4975.72 | 4978.03 | −0.780 |
| D8 | 4695.40 | 4698.64 | −1.159 |
| C#8 | 4184.61 | 4186.01 | −0.565 |

Returning to FIG. 1, each of taps 64–75 of synthesizer 62 are conducted through a cable 78 to twelve separate inputs of twelve single stage dividers 80. Each of the separate stages of divider 80 includes a flip-flop circuit which divides the repetition rate of its input signal in half. Thus, the tone pulse waveform appearing on conductor 75 (corresponding to pitch B8) is divided in half by the first stage of divider 80 to form note B7, one octave below note B8, on output conductor 95. Each of the other tone pulse waveforms produced by synthesizer 62 are treated in a like manner, so that the divider 80 produces the tone pulse waveforms corresponding to notes C7–B7, respectively.

Each of the output taps of divider 80 are connected through a cable 98 to twelve individual stages of a divider 100 which is identical to divider 80. As a result, divider 100 produces tone pulse waveforms corresponding to notes C6–B6, respectively, The output taps of divider 100 are each conducted through a cable 118 to as many additional divider stages as desired in the instrument. The tone pulse waveforms produced by synthesizer 62, divider 80 and divider 100 differ in octaves, but all correspond to the same system of tempering.

Channel 59 includes divider components identical to those in channel 58. More specifically, channel 59 includes a top octave systhesizer 120 identical to synthesizer 62, cables 128, 148 and 168 identical to cables 78, 98 and 118 respectively; and dividers 130 and 150 identical to dividers 80 and 100, respectively. An additional divider 170 is identical to divider 150.

Figure 1B:
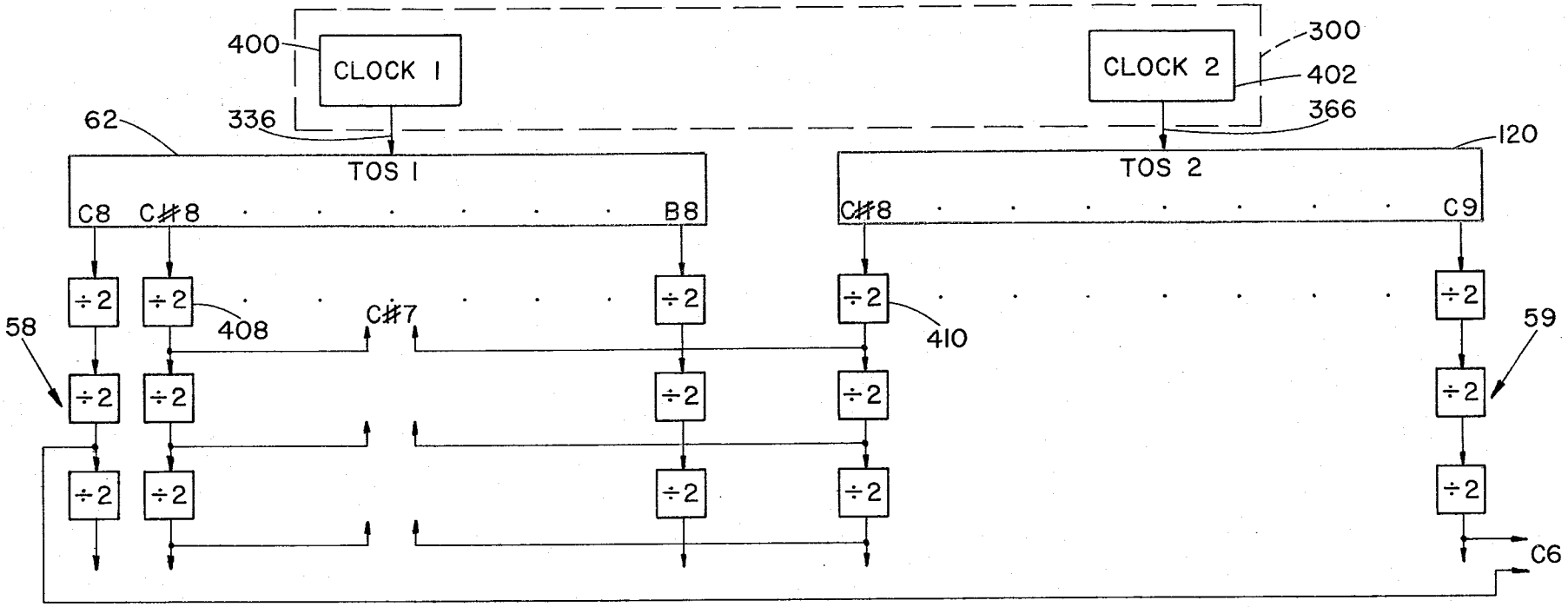
FIG. 1B is a schematic block diagram illustrating certain pertinent portions of the circuit shown in FIG. 1.

The basic operation of the system of the present invention will now be most easily understood with reference to FIG. 1B, which depicts certain pertinent portions of the circuitry shown in FIG. 1. Two clock signal sources 400 and 402, constituting oscillator 300, are provided, the frequency of the clock signal appearing on output 366 of clock 402 being six percent higher, i.e. one semitone, than the frequency of the clock signal appearing on output 336 of clock 400. The clock sources 400 and 402 are coupled to a plurality of divide by two circuits comprising dividers 80, 100, 130, 150 and 170 through synthesizers 62 and 120. As a result of these connections, the tone pulse waveforms produced by synthesizer 120 are shifted in frequency by one semitone with respect to the tone pulse waveforms produced by synthesizer 62 as represented by the note designations shown at the synthesizer outputs. Thus, the lowest frequency output of synthesizer 62 corresponds to pitch C8 while the lowest frequency output of synthesizer 120 corresponds to pitch C#8.

Now, and as previously discussed, it is a feature of currently available top octave synthesizers that, although the different output frequencies differ from each other by approximately one semitone in comparing frequencies available on adjacent outputs, there is a small but significant error, and the error is different for each pair of adjacent outputs. It is therefore apparent that by employing the two synthesizers 62 and 120, and by selecting outputs from the two, or their associated dividers, which are nominally at the same frequency but which are not exactly so because of the fact that they are derived from different outputs of the synthesizers, it is possible to select pairs of tone pulse waveforms for application to the modifiers 180 which are nearly equal in frequency but which differ by a small error from being precisely the same frequencies. Thus, for example, the C#8 tone pulse waveform taken from the second tap of synthesizer 62 will have a frequency slightly different from that of the C#8 tone pulse waveform taken from the first tap of synthesizer 120. Application of these two tone pulse waveforms to one of the modifiers 180 will therefore result in the production of the desired chorus effect. It will be appreciated that similar results are achievable by combining other corresponding tone pulse waveforms, such as the C#7 tone pulse waveforms developed by the dividers 408 and 410.

FIGS. 2–7 show in more detail another embodiment of the invention. In this embodiment, the output taps of synthesizers 62 and 120 have been labelled with corresponding note designations although, it will be recognized that the frequencies of the tone pulse waveforms actually produced at the taps will depend upon the input clock frequencies from oscillator 300. Thus, if the input clock signals applied to synthesizers 62 and 120 are identical, the frequencies of the tone pulse waveforms on corresponding taps will be equal. On the other hand, if synthesizer 120 is driven by a clock signal one semitone higher than synthesizer 62, the actual frequencies of the tone pulse waveforms produced by synthesizer 120 will be shifted as illustrated in FIG. 1B and will not, in fact, conform to the note designations shown in FIG. 2 where, for example, the note on tap 144 will have a frequency actually approximating B7 rather than A#7. And, when this tone pulse waveform is combined with the tone pulse waveform on conductor 95 (also corresponding to B7 but varying slightly from that produced on conductor 144) by modifier 204, a chorus effect is achieved. As before, the small frequency error between the two signals applied to modifier 204 results from their being derived from non-corresponding taps of synthesizers 62 and 120.

Figure 2:
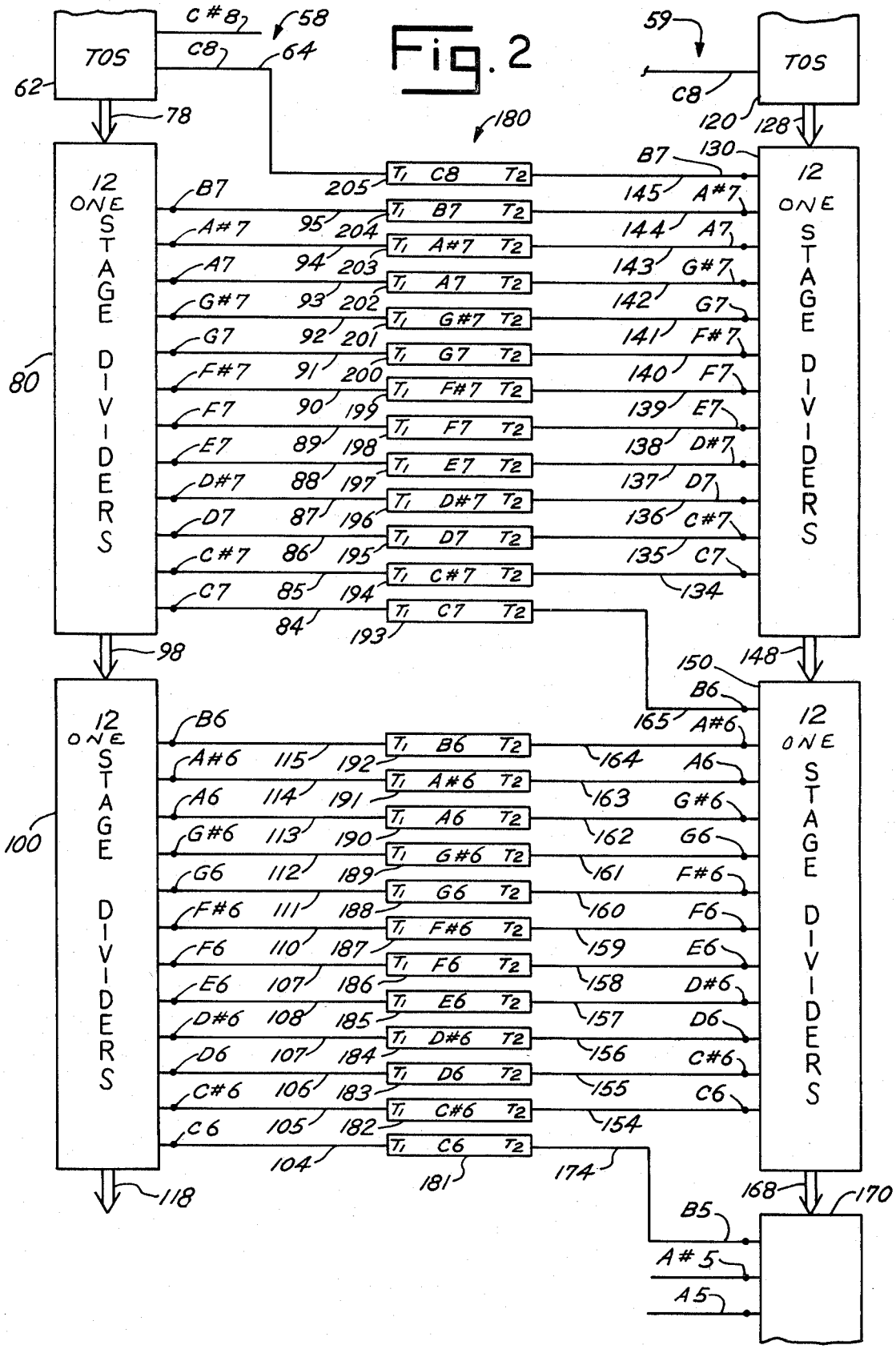
FIG. 2 is a schematic block diagram describing in detail the divider and modifier system used in connection with FIG. 1.

Referring to FIG. 2, it will be observed that the output taps of dividers 80, 100, 130, 150 and 170 are connected to individual modifier circuits 181–205 of modifier and control system 180. A separate modifier circuit is provided for each key of the keyboard and is labeled with the note produced by its corresponding key. Moreover, it will be noted that each modifier circuit is connected to non-corresponding taps of a pair of dividers. Basically, the dividers in channel 59 are shifted one semitone lower than the dividers of channel 58 with respect to the modifier circuits. For example, the C8 output of synthesizer 62 is connected to modifier 205, whereas the B7 tap of divider 130 is connected to modifier 205. Likewise, the B7 tap of divider 80 is connected to modifier 204, whereas the A#7 tap of divider 130 is connected to modifier 204. This pairing arrangement continues for all of the modifiers. As a result of this arrangement, the tone pulse waveforms generated in channel 58 by synthesizer 62, divider 80 and divider 100 are arranged according to a different tempered scale from the tone pulse waveforms generated in channel 59 by dividers 130, 150 and 170.

As described in more detail later, oscillator 300 tunes the C outputs of channel 58 (i.e., the C outputs of synthesizer 62, divider 80 and divider 100) to the same frequency as the B outputs of channel 59 (i.e., the B outputs of synthesizer 120 and dividers 130, 150 and 170). For example, the C8 output of synthesizer 62 has the same repetition rate as the B7 output of divider 130, and the C7 output of divider 80 has the same repetition rate as the B6 output of divider 150. However, since the ratios of frequencies between adjacent taps on the dividers are not equal, the remaining pairs of tone pulse waveforms from channel 58 and 59 supplied to the same modifier circuit are slightly different in frequency. Moreover, within each octave, the tone pulse waveforms supplied by channel 58 are tuned according to a tempered scale which is different from the tempered scale corresponding to the tone pulse waveforms supplied by channel 59. The result of transmitting to each modifier circuit pairs of tone pulse waveforms tuned according to different tempered scales is graphically illustrated in Table B:

TABLE B

| (1) Note | (2) Modifier Circuit Receiving Pulses From Dividers | (3) Cents Error Of Waveform Received From Synthesizer 62 Or Divider 80 | (4) Cents Error Of Waveform Received From Divider 130 Or 150 | (5) Cents Of Difference In Frequency Between Wave-Forms Received From Different Dividers |
|---|---|---|---|---|
| C8 | 205 | −.565 | −.565 | 0 |
| B7 | 204 | +.842 | −.288 | 1.13 |
| A#7 | 203 | +1.119 | −.667 | 1.786 |
| A7 | 202 | +.740 | −1.295 | 2.035 |
| G#7 | 201 | −.112 | −1.831 | 1.943 |
| G7 | 200 | −.424 | −1.987 | 1.519 |
| F#7 | 199 | −.580 | −1.524 | .944 |
| F7 | 198 | −.117 | −.247 | .13 |
| E7 | 197 | +1.160 | −2.187 | 3.347 |
| D#7 | 196 | −.780 | −2.566 | 1.786 |
| D7 | 195 | −1.159 | −1.331 | .172 |
| C#7 | 194 | +.076 | −1.972 | 2.048 |
| C7 | 193 | −.565 | −.565 | 0 |

Column 1 describes the notes in the octave C7 and C8. These notes are generated by modifier circuits 193–205 which receive input signals from the like-lettered keys. Column 2 in Table B describes the modifier circuit receiving pulses from channels 58 and 59 in order to generate tone signals resulting in the notes shown in column 1. Column 3 of Table B describes in cents the error by which the frequency of the waveform received from channel 58 deviates from the equally tempered scale. Column 4 of Table B describes in cents the error by which the frequency of the waveform received from channel 59 deviates from the equally tempered scale. Column 5 of Table B shows the cents of difference in frequency between the waveforms received from channels 58 and 59. As noted in column 5, with the exception of the C7 and C8 notes, each of the modifier circuits receives tone pulse waveforms which deviate in frequency from each other by 0.13 to 3.347 cents.

As shown in FIG. 1, each of the modifier circuits includes input terminals M1, M2, T1, T2 and K, as well as an output terminal 0. Basically, each modifier circuit receives a tone pulse waveform from channel 59 through an input T1 and receives a corresponding tone pulse waveform from channel 59 through an input T2. Control signals for modifying the tone pulse waveforms from channels 58 and 59 are received through inputs M1 and M2. If the player wants to sound the note corresponding to a modifier circuit, he depresses a corresponding key which generates a control signal received through input K. In response to the control signal, the tone pulse waveforms from channels 58 and 59 are mixed and transmitted through output terminal 0 where they can be amplified and converted to an acoustic wave.

In addition to modifier circuits 181–205, modifier and control system 180 includes shape modulation oscillators 210, 212. Each of these oscillators generates a triangular waveshape. Oscillator 210 generates a triangular waveshape of predetermined appropriate amplitude at a shape modulation rate of 6.3 cycles per second, and oscillator 212 generates a triangular waveshape of predetermined, appropriate amplitude at a shape modulation rate of 6.0 cycles per second. Waveshape control circuits 214, 216 establish an adjustable DC signal level for oscillators 210 and 212, respectively. The adjustable DC and triangular waveshape signals are mixed in summing circuits 218, 220 and are thereafter transmitted to control buses 222, 224 through manually actuated switches 223, 225, respectively.

The depression of a key by the player results in a control signal on a corresponding conductor connected to a modifier circuit. Referring to FIG. 1, exemplary control conductors 226–231 are illustrated in connection with modifier circuits 205, 204, 193, 192, 191 and 181.

Figures 3, 4:
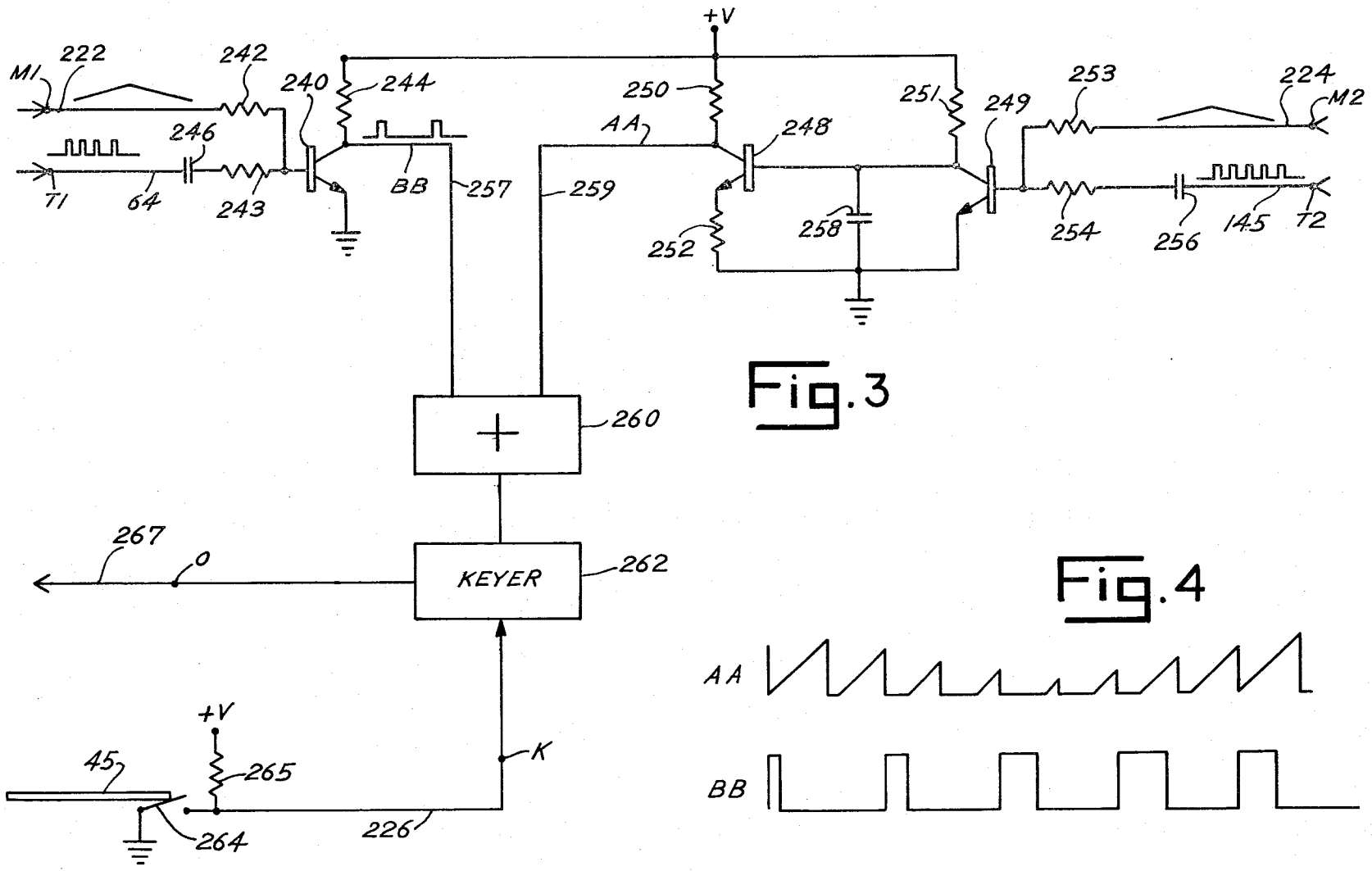
FIG. 3 is an electrical schematic drawing of a preferred form of modifier circuit shown in FIG. 1.
FIG. 4 is a waveform diagram illustrating the voltage waveforms occurring at points AA and BB of FIG. 3.

Each of the modifier circuits 181–205 is identical and may be understood with reference to the following discussion of exemplary modifier circuit 205 as shown in FIG. 3. Modifier circuit 205 includes a transistor 240 and associated resistors 242–244 connected as shown. The tone pulse waveform received on input conductor 64 through terminal T1 is differentiated by differentiating capacitor 246. Circuit 205 also includes transistors 248, 249 and associated resistors 250–254 connected as shown. The tone pulse waveform received on conductor 145 through terminal T2 is differentiated by differentiating capacitor 256. If transistor 249 is switched to its non-conductive state, current is conducted to a charge storage capacitor 258 through a resistor 251 which is connected to a source of positive voltage V. If transistor 249 is switched to its conductive state, capacitor 258 is rapidly discharged.

The manner in which transistor 240 shape modulates the tone pulse waveform received on conductor 64 is illustrated in FIG. 4 in connection with waveform BB. Assuming switch 223 (FIG. 1) is closed so that a shape modulating signal is received on conductor 222, the pulses received on conductor 64 are width modulated in the manner shown by waveform BB at the shape modulation rate of the signal received on conductor 222. The form of pulse width modulation performed by transistor 240 is trailing edge modulation. That is, the trailing edge of the pulses varies in time with respect to the leading edge, but the position of the leading edge with respect to time is not altered.

The manner in which transistors 249 and 248 shape modulate the tone pulse waveform received on conductor 145 is illustrated in connection with waveform AA of FIG. 4. Assuming switch 225 is closed (FIG. 1), the collector of transistor 248 produces a sawtooth waveform which is shape modulated in the manner shown by waveform AA at the shape modulation rate of the signal received on conductor 224.

If either switch 223 or 225 is closed, the shape of the tone pulse waveform received on either conductor 64 or 145 is altered with respect to time so that the resulting tone pulse signals generated on conductors 257 and 259 deviate dynamically from each other. If both of the switches 223 and 225 are open, no shape modulating signal is received on either conductor 222 or 224. In this mode of operation, a pulse waveform having a constant width and fixed shape is generated on conductor 257 and a sawtooth waveform having a fixed shape is generated on conductor 259 so that the shapes of the resulting tone signals on conductors 257 and 259 deviate statically.

The tone signals generated on conductors 257 and 259 are mixed in a summing circuit 260 and are conducted to output terminal 0 by a conventional keyer 262 in response to a 0 volt signal on control conductor 226. As shown in FIG. 3, the depression of key 45 closes switch 264 which places a 0 volt signal on conductor 226. If key 45 is not depressed, conductor 226 is biased at a positive voltage from a source of DC potential +V through a resistor 265.

Each of the other modifier circuits contains an output conductor similar to conductor 267 shown in FIG. 3. In order to clarify the explanation, only output conductors 268–272 have been shown in FIG. 1.

Figure 5:
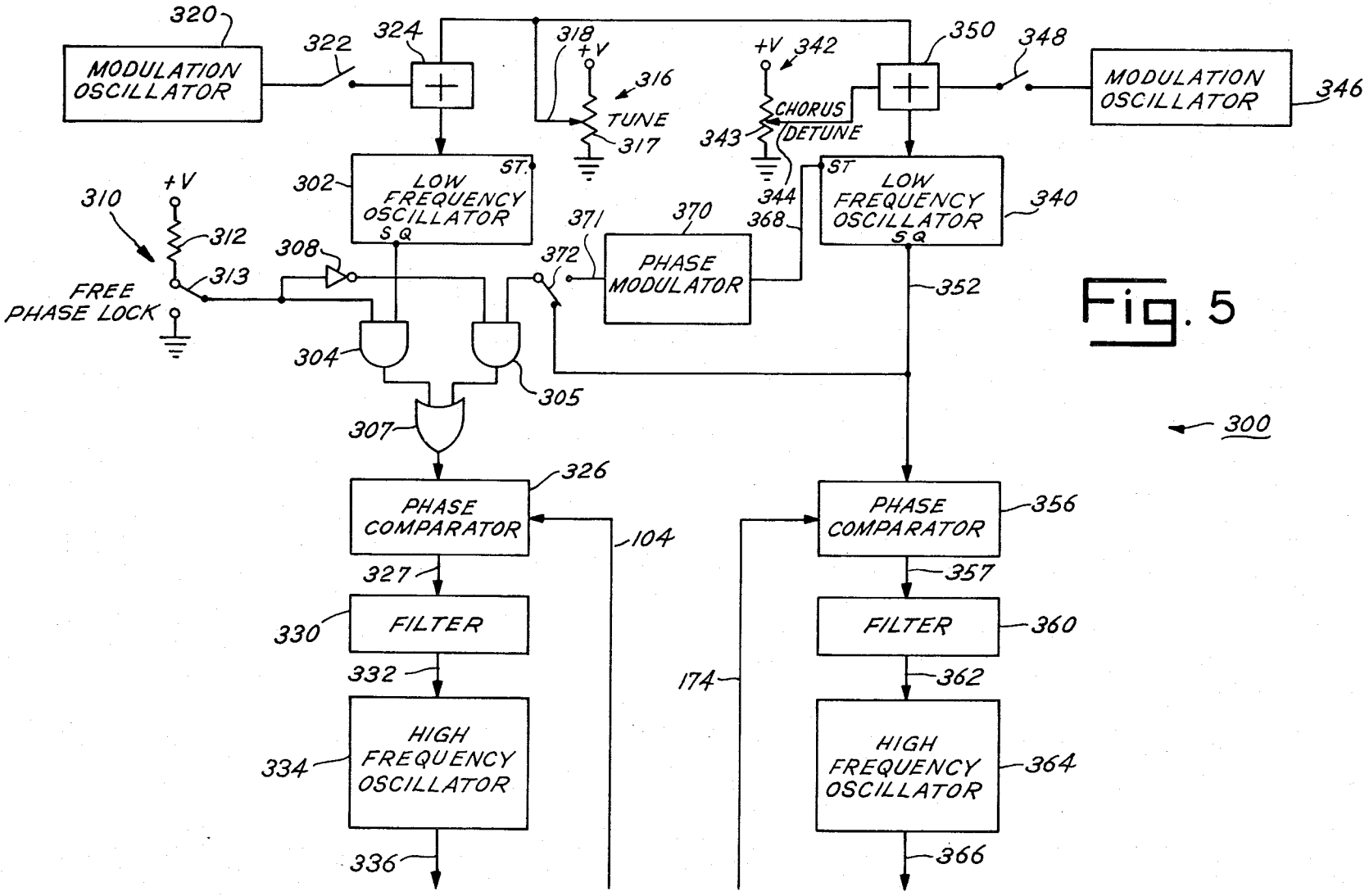
FIG. 5 is a detailed schematic diagram of the oscillator shown in FIG. 1.

Referring to FIG. 5, oscillator system 300 comprises a group of components which supply clock pulses to channel 58 and an analogous group of components which supply clock pulses to channel 59. Channel 58 includes a low frequency voltage-controlled oscillator 302 of a well-known design. Oscillator 302 produces squarewave timing pulses at an output SQ and sawtooth timing pulses at output ST. In the present embodiment, the oscillator is adjusted to produce the timing pulses at a nominal center repetition rate of 1046 cycles per second, although this rate can be frequency modulated above and below the center rate.

The SQ output of oscillator 302 is conducted through a logic circuit comprising logical AND gates 304, 305, a logical OR gate 307, and an inverter 308. The logical circuit is controlled by a selection circuit 310 comprising a resistor 312, which is connected to the positive source of voltage +V and a switch 313. When switch 313 is in the free position shown in FIG. 5, the timing pulses produced by oscillator 302 are conducted through the logic circuit.

The frequency of oscillator 302 is controlled by a tune potentiometer 316 comprising a resistor 317 and a slider 318, as well as by a frequency modulation oscillator 320. Oscillator 320 produces a triangular waveform of predetermined, appropriate amplitude at a modulation frequency of 4.7 cycles per second. If a switch 322 is closed, the DC tune signal from potentiometer 316 and the waveform from oscillator 320 are mixed in a summing circuit 324 and are transmitted to the input of oscillator 302. In this mode of operation, the frequency of the timing pulses produced by oscillator 302 are frequency modulated at the rate of 4.7 cycles per second.

Assuming switch 313 is in the free position shown in FIG. 5, the output of oscillator 302 is conducted to the input of a phase comparator 326 which may be implemented by model CD 4046 manufactured by Radio Corporation of America. Comparator 326 compares the phase of the timing pulses from oscillator 302 with the phase of the tone pulse waveform received from conductor 104 (tap C6 of divider 100). Comparator 326 generates a correction signal having a magnitude proportional to the difference between the phase of the timing pulses and the tone pulse waveform. The correction signal is transmitted to output conductor 327, is converted to a corresponding DC level by filter 330 and is conducted to a voltage-controlled, high-frequency oscillator 334 through an output conductor 332. The correction signal alters the repetition rate of the clock pulses produced by oscillator 334 so that the frequency and phase of the timing pulses from oscillator 302 are identical to the frequency and phase of the tone pulse waveform on conductor 104.

Channel 59 components within oscillator 300 comprise a low-frequency, voltage-controlled oscillator 340, identical to oscillator 302, which also produces timing pulses at a nominal repetition rate of 1046 cycles per second. The repetition rate of the timing pulses from oscillator 340 is controlled by tune potentiometer 316, a chorus detune potentiometer 342 comprising a resistor 343 and a slider 344, and a frequency modulation oscillator 346. Oscillator 346 produces a triangular waveform at a modulation frequency of 5.5 cycles per second. If a switch 348 is closed, a DC voltage from slider 344 is added to the waveform from oscillator 346 in a summing circuit 350, and the summed signals control the repetition rate of oscillator 340.

The amplitudes of the triangular waveforms generated by oscillators 320 and 346 are adjusted so that the repetition rates of oscillators 302 and 340, respectively, are frequency modulated by approximately one percent.

The square wave (SQ) output of oscillator 340 is transmitted over a conductor 352 to a phase comparator 356 identical to phase comparator 326. Phase comparator 356 compares the phase of the timing pulses from oscillator 340 with the phase of the tone pulse waveform produced on conductor 174 (tap B5 of divider 170). Comparator 356 generates a correction signal having a value proportional to the difference between the phase of the timing pulses and the tone pulse waveform on conductor 174. The correction signal is transmitted over a conductor 357 into a filter 360 which generates a corresponding DC level on an output conductor 362. The DC level controls the frequency of oscillator 364 so that the repetition rate of the tone pulse waveform on conductor 174 is maintained at the same frequency and phase as the timing pulses produced by oscillator 340. The clock pulses produced by oscillator 364 are conducted to synthesizer 120 over an output conductor 366.

The sawtooth timing pulses produced by oscillator 340 at output ST are transmitted over a conductor 368 to a phase modulator 370. Modulator 370 produces phase modulated pulses on output conductor 371 which can be transmitted through a switch 372 to the input of AND gate 305. When AND gate 305 is enabled by the movement of switch 313 into the grounded, phase lock position shown in FIG. 5, the output from modulator 370 can be transmitted to the input of phase comparator 326.

Figure 6:
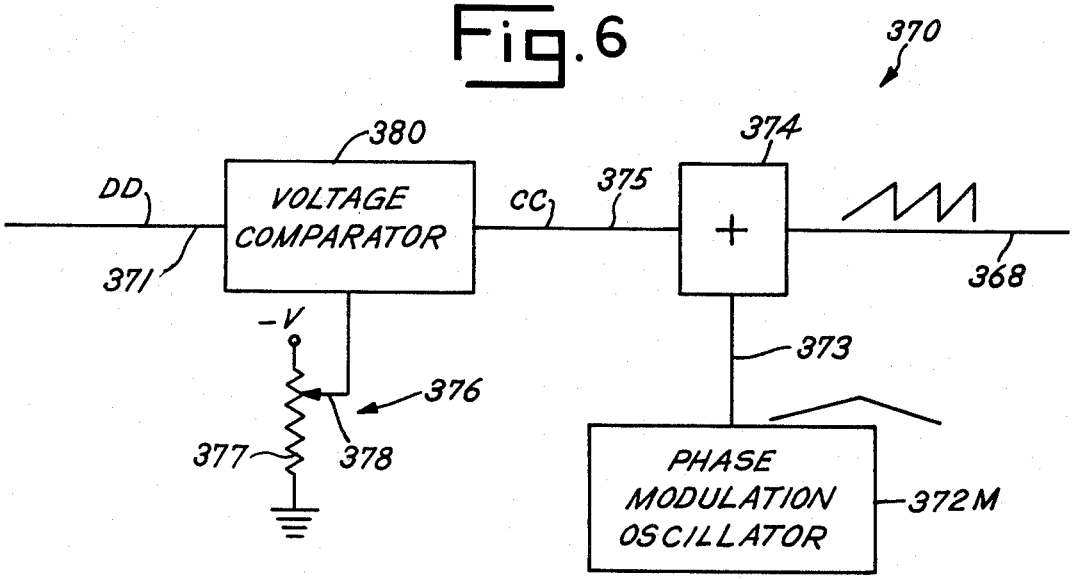
FIG. 6 is a detailed block diagram illustrating the phase modulator shown in FIG. 5.

Referring to FIG. 6, phase modulator 370 comprises a phase modulation oscillator 372M which produces a triangular waveform at a rate of about 5 cycles per second. The triangular waveform is transmitted over a conductor 373 to a summing circuit 374 which receives the sawtooth timing pulses over conductor 368. The summing circuit mixes the sawtooth and triangular waveforms to produce on conductor 375 an output waveform CC shown in FIG. 7. Waveform CC is transmitted to the input of a voltage comparator 380 which also receives a negative reference voltage from a reference potentiometer 376 comprising a resistor 377 and a slider 378. Resistor 377 is connected between ground potential and a source of negative voltage −V. Response to its input signals, voltage comparator 380 produces a series of width modulated pulses DD shown in FIG. 7. The particular form of width modulation employed is leading edge modulation. That is, the trailing edges of the pulses shown in waveform DD remain in the same relative position with respect to time, but the leading edges are advanced or retarded at the rate of phase modulation oscillator 372M (e.g., 5 cycles per second).

The switches and controls of the above-described circuitry may be used in a number of ways to simulate the sound of a chorus. For example, if all the switches are maintained in the positions shown in FIGS. 1 and 5, the circuitry is in the free mode. In this mode, oscillator 302 is adjusted in frequency by moving slider 318 until the tone pulse waveform on conductor 104 achieves an appropriate repetition rate (e.g., 1046 cycles per second). The frequency of oscillator 340 then is adjusted by manipulating slider 344 until the repetition rate of the tone pulse waveform on conductor 174 is the same as the tone pulse waveform on conductor 104 (i.e., the C6 tap of divider 100 is tuned to the same frequency as the B5 tap of divider 170). Consequently, the repetition rate of the clock signal on conductor 366 will be one semitone higher than the repetition rate of the clock signal on conductor 336.

Thus, in this free mode of operation, as previously explained, the repetition rates of the waveforms produced by dividers 80 and 100 are tuned according to one tempered scale, whereas the repetition rates of the waveforms produced by dividers 130, 150, 170 are tuned according to a different tempered scale (FIG. 2). That is, the repetition rates of the waveforms produced on conductors 84–95 and 64 correspond to one tempered scale, whereas the repetition rates of the waveforms produced on conductors 165 and 134–145 correspond to a different tempered scale. In response to the depression of any of the keys 34–44 (C♯7–B7), modifier circuits 194–204 combine a pair of tone pulse waveforms each of which is produced according to a different tempered scale and each of which differs from the other in frequency. These tone pulse waveforms are mixed and converted to an acoustical wave to simulate a chorus sound.

When switch 313 is in the free mode, in order to provide additional difference in frequency between the tone pulse waveform transmitted to each modifier circuit, chorus detune slider 344 can be varied in order to detune all of the tone pulse waveforms produced in channel 59 compared to the tone pulse waveforms produced in channel 58.

Additional effects useful in simulating the sound of a string chorus can be achieved by closing switch 322 (FIG. 5) in order to frequency modulate the timing pulses generated by oscillator 302. The frequency modulation of oscillator 302 results in the modulation of the repetition rate of the clock pulses produced by oscillator 334. As a result of this operation, each of the tone pulse waveforms generated by the taps of dividers 80 and 100 in channel 58 is defined by a repetition rate having a value which oscillates at the modulation frequency of oscillator 320 around a center rate. A similar effect can be achieved in channel 59 by closing switch 348. As a result of this operation, each of the tone pulse waveforms generated in channel 59 by the taps of dividers 130, 150 and 170 are defined by a repetition rate having a value which oscillates at the frequency of oscillator 346 around a center rate.

Additional effects useful in simulating the sound of a chorus can be generated by closing switch 223 (FIG. 1) which causes the pulse width modulation of the tone pulse waveforms received at input T1 of the modifier circuits. Likewise, switch 225 can be closed in order to dynamically alter, with respect to time, the shape of the tone pulse waveforms received at inputs T2 of the modifier circuits. The shape modulation of each of the resulting tone signals has previously been described in connection with FIGS. 3 and 4.

Tone pulse waveforms tuned according to differently tempered scales can be automatically transmitted to each modifier circuit by adjusting low frequency oscillator 340 to a repetition rate of 1046 cycles per second and by moving switch 313 (FIG. 5) to the grounded or phase lock position. In this mode of operation, timing pulses are provided to both channels 58 and 59 by oscillator 340, and the repetition rates and phases of the tone pulse waveforms on conductors 104 and 174 are identical to the repetition rates and phases of the timing pulses produced by oscillator 340.

As long as switch 372 is in the position shown in FIG. 5, the repetition rates of the tone pulse waveforms on the C taps of the channel 58 dividers are identical to the repetition rates of the tone pulse waveforms on the corresponding B taps of the channel 59 dividers. For example, the C7 tap of divider 80 is tuned to the same frequency as the B6 tap of divider 150. In order to vary the repetition rates on these taps so that the chorus effect is increased, switch 372 is moved in contact with output conductor 371 so that phase modulator 370 is operated. Phase modulator 370 varies the phase or pulse width of the timing pulses transmitted to phase comparator 326 so that the frequency of the C taps in channel 58 dynamically varies with respect to the corresponding taps in channel 59. For example, the frequency of the tone pulse waveform on conductor 64 (tap C8 of synthesizer 62) will oscillate with respect to the frequency of the tone pulse waveform on conductor 145 (tap B7 of divider 130).

Due to the operation of phase modulator 370, the repetition rate of each of the tone pulse waveforms produced on the taps of dividers 80 and 100 will oscillate slightly above and below its normal frequency, and, therefore, will vary dynamically with respect to the corresponding repetition rate of each of the tone pulse waveforms produced by dividers 130 and 150 in channel 59. This slight variation of frequency adds an additional characteristic useful for simulating the sound of a string chorus.

In the phase lock mode of operation, switch 348 can be closed in order to frequency modulate, as well as phase modulate, the timing pulses produced by oscillator 340. In addition, shape modulation can be obtained in the manner previously described by closing either or both of switches 223 and 225 (FIG. 1).

In addition to the advantages described above, the phase lock mode of operation also has the additional advantage of maintaining the repetition rates of the tone pulse waveforms at an exact, predetermined value over a long period of time. Voltage-controlled, high-frequency oscillators are notoriously unstable, and the industry has long sought a method of insuring that electronic musical instruments do not go out of tune due to changes in parameter values or temperature conditions. It has been discovered that the desired degree of stability can be permanently maintained if the operation of the high frequency oscillator is locked to a stable low frequency oscillator by use of a phase comparator in the manner described in connection with FIG. 5.

Those skilled in the art will recognize that only one preferred embodiment of the invention has been disclosed. This embodiment may be altered and modified without departing from the true spirit and scope of the invention as defined in the appended claims.

I claim:

1. For use in an electronic musical instrument having a keyboard with a plurality of keys and an output system adapted to receive tone signals and convert them into sound waves, a tone signal generator for generating a plurality of tone signals comprising:

first and second sources of clock pulses differing in frequency by an integral number of semitones;

first and second top octave synthesizer means connected respectively to said first and second clock pulse sources for producing, respectively, first and second series of tone pulse signals, each of said series corresponding to a different tempered scale; and means responsive to the operation of said keys for simultaneously supplying said output system with two tone pulse signals of approximately the same frequency derived individually from non-corresponding outputs of said first and second top octave synthesizer means, whereby the sound of a chorus is simulated.

2. The tone generator according to claim 1 wherein said integral number of semitones comprises one semitone.

3. The tone signal generator according to claim 2 including divider means responsive to said first and second top octave synthesizer means for producing tone pulse signals octavely related to said first and second series of tone pulse signals.

4. In an electronic musical instrument having a keyboard with a plurality of keys and an output system adapted to receive tone signals and convert them into sound waves, a tone signal generator for generating a plurality of tone signals comprising:

clock means comprising low frequency oscillator means for generating a series of timing pulses, a first phase lock loop responsive to said timing pulses for generating a first clock signal and a second phase lock loop responsive to said timing pulses for generating a second clock signal, said first and second phase lock loops including, respectively, first and second frequency dividers having division factors differing by an integral number of semitones;

first and second top octave synthesizer means respectively connected for receiving said first and second clock signals for producing, respectively, first and second series of tone pulse signals, each of said series corresponding to a different tempered scale;

divider means responsive to said first and second top octave synthesizer means for producing tone pulse signals octavely related to said first and second series of tone pulse signals; and means responsive to the operation of said keys for simultaneously supplying said output system with two tone pulse signals of approximately the same frequency derived individually from non-corresponding outputs of said first and second top octave synthesizer means, whereby the sound of a chorus is simulated.

* * * * *